United States Patent [19]

Kessel

[11] Patent Number: 4,794,700

[45] Date of Patent: Jan. 3, 1989

[54] CAGE FOR MARKING THE BOTTOMS OF DOORS PREPARATORY TO CUTTING THE SAME

[76] Inventor: Donald E. Kessel, 620 N. Brinton Ave., Dixon, Ill. 61021

[21] Appl. No.: 97,675

[22] Filed: Sep. 17, 1987

[51] Int. Cl.[4] ..... G01B 3/14

[52] U.S. Cl. ..... 33/194; 33/562

[58] Field of Search ..... 33/194, 562, 563, 565, 33/667

[56] References Cited

U.S. PATENT DOCUMENTS 3,834,034 9/1974 Berquist ..... 33/194

*Primary Examiner*—William D. Martin, Jr.

*Attorney, Agent, or Firm*—Leydig, Voit & Mayer

[57] ABSTRACT

A gage for marking a cutting line across the lower end portion of a door to facilitate cutting of the door to the proper length to clear carpeting, a threshold or the like. The gage includes an elongated rod which adjustably supports fixturing members having hinge curls adapted to interleave with the curls of the hinge wings on the door jamb and adapted to be attached to the wings by hinge pins. Once the rod has been fixtured, an elongated marking guide on the lower end portion of the rod is adjusted vertically and angularly to a position in which the lower edge of the guide just clears the floor or threshold when the guide is swung about the axis of the rod. After the guide has been locked in its properly adjusted position on the rod, the gage is detached from the door jamb and is placed on the door with the curls of the fixturing members in alinement with curls on the hinge wings of the door. A cutting line then is marked along the lower end portion of the door by following the lower edge of the marking guide.

8 Claims, 2 Drawing Sheets

CAGE FOR MARKING THE BOTTOMS OF DOORS PREPARATORY TO CUTTING THE SAME

BACKGROUND OF THE INVENTION

This invention relates to a gage for facilitating the marking of a cutting line across the bottom of a hinged door preparatory to cutting the door to proper length for clearing a floor covering or for seating against a threshold.

Presently used methods for establishing a proper cutting line across the bottom of a hinged door are tedious and time consuming and often involve trial-and-error. With presently used measuring and marking methods, it is not unusual to ruin the appearance and/or sealing characteristics of a door by cutting off too much material from its bottom or to leave so much material that the door will not freely swing and properly close. Even experts find it difficult to mark the door so the bottom of the door may be cut at the proper height and angle.

SUMMARY OF THE INVENTION

The general aim of the present invention is to provide a new and improved door marking gage which is simple and easy to use, which enables very precise marking of the door and which is of relatively inexpensive construction.

A more detailed object of the invention is to provide a door marking gage which is adapted to be temporarily fixtured to the door jamb and which includes a swingable marking guide adapted for vertical and angular adjustment to a position assimilating the correct position for the bottom of the door so that the guide may subsequently be used in establishing a proper cutting line across the bottom of the door.

The invention also resides in the novel construction of the gage enabling the gage to be quickly fixtured and adjusted, enabling the gage to be used either with left or right hand doors and enabling the gage to be collapsed to a relatively compact storage position.

These and other objects and advantages of the invention will become more apparent from the following detailed description when taken in conjunction with the accompanying drawings.

DETAILED DESCRIPTION OF THE PREFERRED EMBODIMENT

Figure 1:
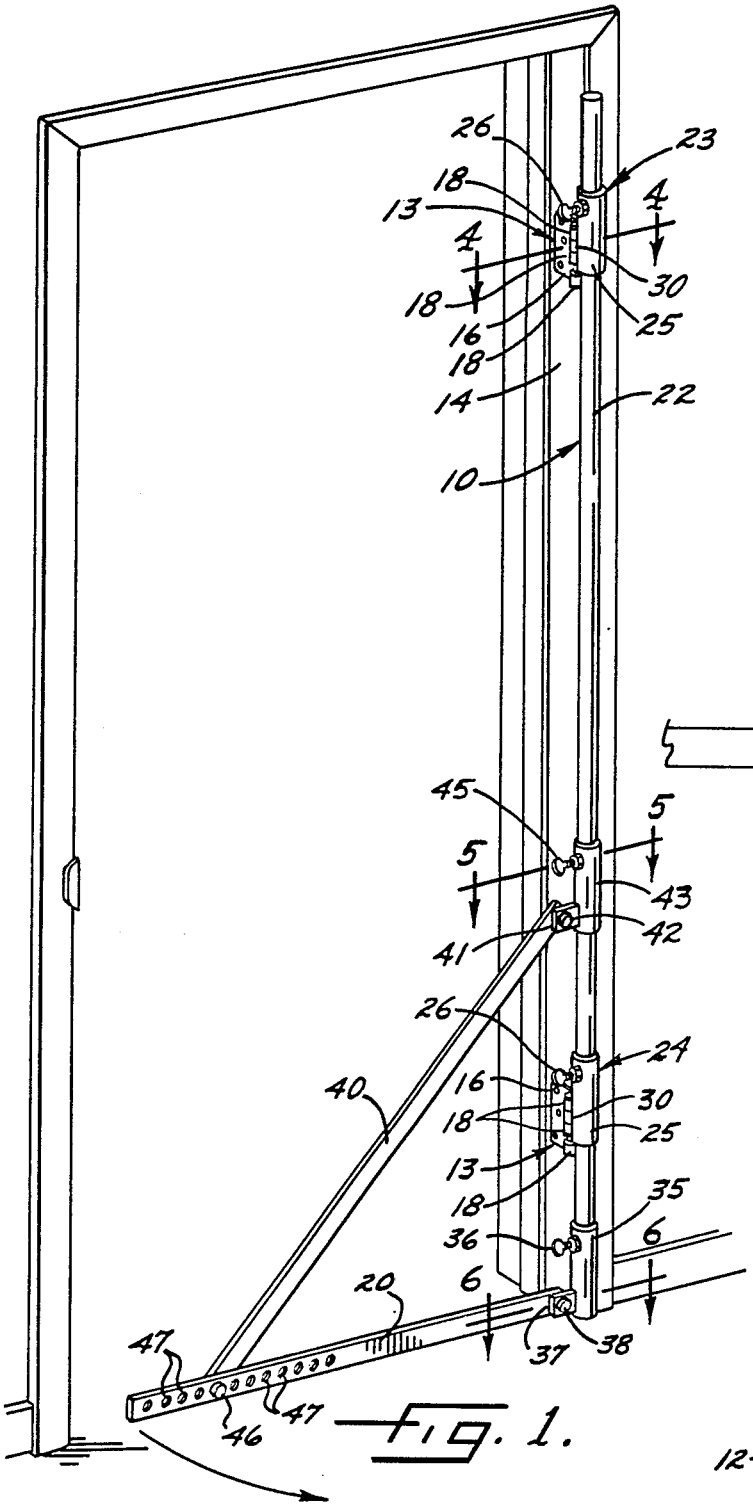
FIG. 1 is a perspective view of a new and improved door marking gage incorporating the unique features of the present invention and shows the gage fixtured in position on a door jamb.

For purposes of illustration, the invention is shown in the drawings as incorporated in a gage 10 for facilitating the marking of a cutting line 11 (FIG. 3) across the bottom portion of a hinged door 12. When new carpeting or a new threshold is installed in a room, the pre-existing door often is too long to swing freely across the carpeting or to move into closing relation with the threshold. It thus becomes necessary to trim the door.

The present door 12 is of standard construction and includes upper and lower hinges 13 which support the door on a door jamb 14 for swinging between open and closed positions about an upright axis. The hinges also are of standard construction and each includes a door part or wing 15 (FIG. 3) and a jamb part or wing 16 (FIGS. 1, 2 and 4) secured to the door 12 and the jamb 14, respectively. Each door wing 15 includes two tubular curls 17 (FIG. 3) which interleave with three tubular curls 18 (FIGS. 1, 2 and 4) on the jamb wing 16. A vertical hinge pin 19 (FIGS. 2 and 4) extends through the various curls in order to attach the door swingably to the jamb.

In accordance with the present invention, provision is made of a new and improved marking gage 10 which is adapted to be temporarily fixtured to the jamb wing 16 of at least the lower hinge 13. The gage includes a marking guide 20 which, when the gage 10 is fixtured, may be adjusted to a position precisely assimilating the position of the bottom of a door of proper length. After the marking guide 20 has been so adjusted, the gage 10 is removed from the door jamb 14 and is positioned on the door 12 in such a manner as to enable the guide to be used to mark a properly located cutting line 11 across the bottom portion of the door.

More specifically, the gage 10 includes an elongated rod 22 made of rigid or lightweight material such as tubular steel or aluminum and having a length of about 75 inches. The rod preferably is cylindrical.

Upper and lower fixturing members 23 and 24 are supported both for selective up and down adjustment and for selective angular adjustment on the rod 22. Herein, the two fixturing members are identical to one another and each includes a sleeve 25 which is telescoped over the rod so as to be slidable and rotatable thereon. A thumb screw 26 (FIG. 4) is threaded into a nut 27 welded to the sleeve 25. The thumb screw also extends through a hole in the sleeve 25 and, when the thumb screw is tightened, its inner end engages the rod 22 and causes the sleeve to become clamped to the rod so as to prevent the sleeve from sliding and turning on the rod.

In carrying out the invention, each of the fixturing members 23, 24 includes a generally cylindrical part 30 which assimilates a part of the hinge 13. Herein, the cylindrical part 30 is defined by an upright tubular curl formed on the end of a curved plate 31 (FIG. 4) which is welded rigidly to the sleeve 25. The curl 30 projects a short distance away from the sleeve 25 and is similar in size and shape to the curls 17 of the door wings 15 of the hinges 23 and 24.

Figure 2:
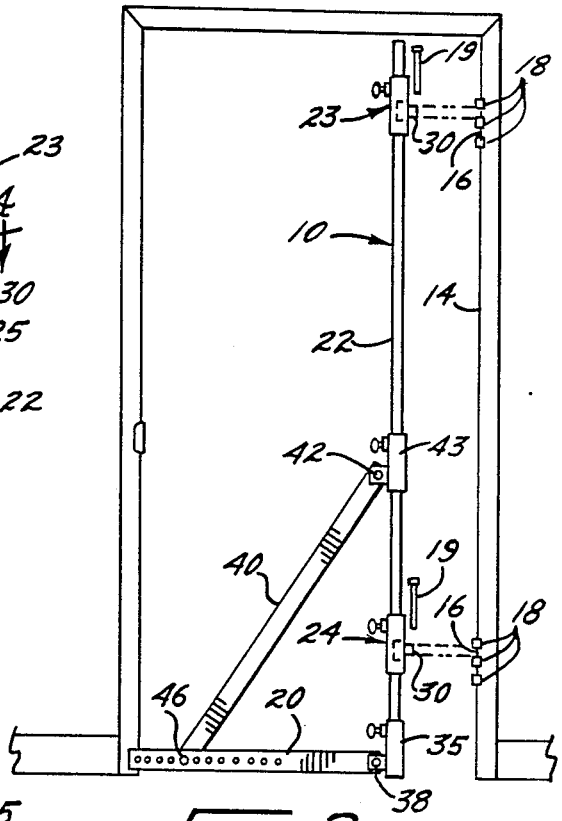
FIG. 2 is a front elevational view of the marking gage and shows the gage exploded away from the door jamb.
Figure 6:
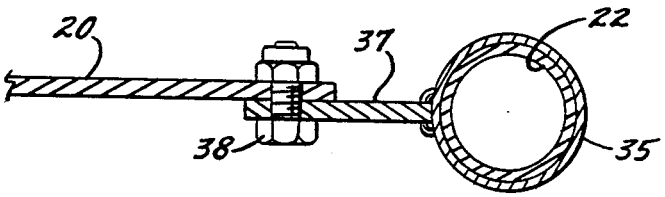
FIG. 6 is an enlarged fragmentary cross-section taken substantially along the line 6—6 of FIG. 1.
Figure 7:
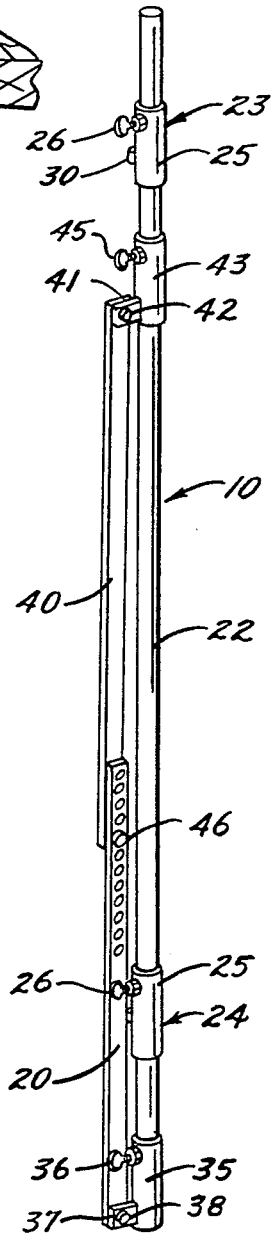
FIG. 7 is a perspective view showing the marking gage collapsed to a storage position.

The marking guide 20 is defined simply by a flat and elongated strip of steel or other rigid material. The marking guide extends generally perpendicular to the lower end portion of the rod 22 and is supported on the rod for both up and down bodily adjustment and for up and down pivotal adjustment. For this purpose, a sleeve 35 is telescoped slidably and rotatably onto the lower end portion of the rod 22 and is adapted to be secured releasably in place by a thumb screw 36 (FIG. 1). An ear 37 (FIG. 6) projects radially from the lower end portion of the sleeve 35 and receives a pivot bolt 38 which also extends through the inner end portion of the marking guide 20. By moving the sleeve 35 upwardly and downwardly on the rod 22, the elevation of the marking guide 20 may be adjusted and, by swinging the guide about the pivot bolt 38, the angular position of the guide may be changed.

The gage 10 is completed by a strut 40 which is adapted to hold the marking guide 20 in a selected angular position. In this instance, the strut 40 is a flat and elongated piece of steel which extends generally diagonally between the rod 22 and the marking guide 20. At its upper end, the strut 40 is connected pivotally to an ear 41 by a pivot pin 42, the ear projecting radially from a sleeve 43. The sleeve 43 is located between the two fixturing members 23 and 24, is slidable upwardly and downwardly on the rod 22, and is adapted to be locked in a fixed position by a thumb screw 45.

At its lower end, the strut 40 is connected to the marking guide 20 by a bolt 46 (FIG. 1) which extends through one of a series of holes 47 formed in the marking guide. When the angle of the marking guide is changed, the bolt 46 is re-positioned in a different one of the holes 47 so as to cause the strut to hold the guide in its adjusted angular position.

To use the gage 10, the door 12 is removed from the jamb 14 by pulling out the hinge pins 19 to separate the door wings 15 from the jamb wings 16. The rod 22 of the gage then is positioned alongside the door jamb and the fixturing members 23 and 24 are adjusted vertically on the rod to bring their curls 30 into vertical alinement with the space between the upper two curls 18 of the jamb wings 16 of the hinges 13 (see FIG. 2). The curls 30 of the fixturing members 23 and 24 then are interleaved with the curls 18 of the jamb wings 16 and are secured to such curls by the hinge pins 19. As a result, the rod 22 is fixtured to the door jamb 14 to turn about an upright axis corresponding to the hinge axis of the door 12.

After the rod 22 has been fixtured to the door jamb 14, the marking guide 20 is adjusted vertically and angularly to such a position that the lower edge of the guide just clears the floor covering or the threshold when the guide is swung back and forth about the axis of the rod. By adjusting the marking guide bodily in an upward or downward direction, the lower edge of the guide is positioned at the correct height for a floor which is perfectly perpendicular to the door. Angular adjustment of the guide permits the guide to be positioned in accordance with any slope which might be present in the floor.

Once the marking guide 20 has been properly positioned, it is fixed in place by tightening the thumbscrew 36 of the sleeve 35, by tightening the thumbscrew 45 of the sleeve 43 and by locating the bolt 46 in the appropriate one of the holes 47 in the guide so as to connect the strut 40 rigidly to the guide. The gage 10 then is released from the door jamb 14 by removing the hinge pins 19.

Figure 3:
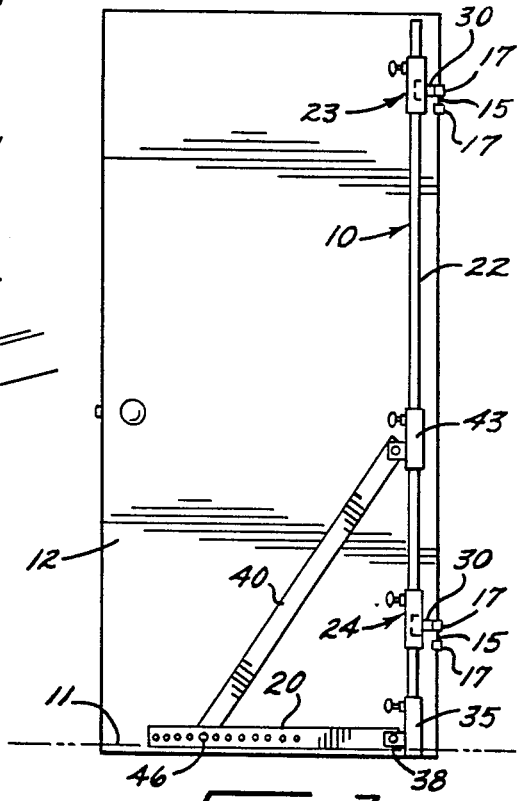
FIG. 3 is a view showing the marking gage positioned on a door to enable a cutting line to be drawn across the bottom portion of the door.
Figure 4:
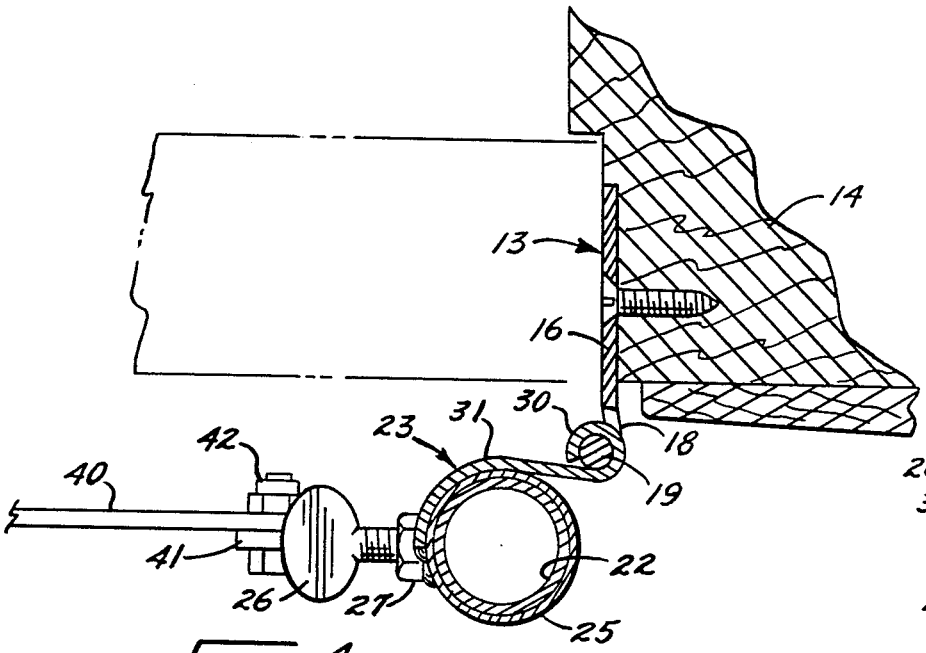
FIG. 4 is an enlarged fragmentary cross-section taken substantially along the line 4—4 of FIG. 1.
Figure 5:
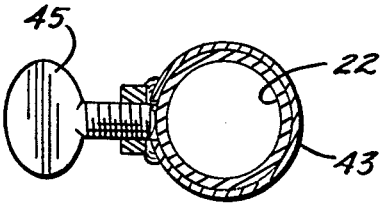
FIG. 5 is an enlarged cross-section taken substantially along the line 5—5 of FIG. 1.

Thereafter, the gage 10 simply is positioned on the door 12 as shown in FIG. 3 such that the curls 30 of the fixturing members 23 and 24 are located closely adjacent and are in vertical alinement with the upper curls 17 of the door. Usually, the gage is positioned on the door while the door is supported in a horizontal position on a pair of saw horses or the like. Once the gage has been so positioned, the cutting line 11 is scribed across the bottom portion of the door by marking along the lower edge of the guide 20. Since such edge accurately represents the correct position of the lower edge of the door, the door will fit perfectly after the bottom portion of the door has been trimmed away along the line 11.

The gage 10 may be used with equal ease in connection with either a left hand door or a right hand door. Also that gage may be easily folded to a compact storage and transport position as shown in FIG. 3. To effect such folding, it is necessary only to loosen the pivot bolts 38, 42 and 46 and to slide the sleeve 43 upwardly along the rod 22.

I claim:

1. A marking gage for facilitating the cutting of a hinged door to a predetermined length, said gage comprising an elongated rod, a fixturing member supported by said rod, said fixturing member having a generally cylindrical part assimilating a pivot connection of a door hinge, an elongated marking guide supported by said rod in spaced relation from said fixturing member and extending generally perpendicular to said rod, means for enabling selective adjustment of the spacing between said fixturing member and said marking guide and for releasably locking said fixturing member and said marking guide in predetermined spaced relation following such adjustment, means supporting said marking guide for up and down pivoting relative to said rod about a generally horizontal axis and in a plane containing the rod and means for releasably locking said guide in any of several selected pivoted positions in said plane.

2. A marking gage as defined in claim 1 in which said means for releasably locking said marking guide in a selected pivoted position relative to said rod comprise a strut extending between said rod and said guide, means enabling selective adjustment of one end of said strut along said rod and for releasably locking said one end of said strut in a selected position along said rod, and a pivotal connection between said guide and the other end of said strut.

3. A marking gage as defined in claim 2 further including means enabling selective adjustment of said pivotal connection along said guide and for releasably holding said pivotal connection in a selected adjusted position along said guide.

4. A marking gage as defined in claim 1 further including a second fixturing member spaced along said rod from said one fixturing member and selectively adjustable toward and away from said one fixturing member, said second fixturing member also having a generally cylindrical part assimilating a pivot connection of a door hinge.

5. A marking gage as defined in claim 4 in which said generally cylindrical parts of said fixturing members are tubular curls.

6. A marking gage for facilitating the cutting of the lower end portion of a door adapted to swing open and closed about an upright axis and on vertically spaced upper and lower hinges, said gage comprising an elongated rod adapted to be located in an upright position, upper and lower fixturing members spaced vertically from one another along said rod, means enabling the vertical spacing between said fixturing members to be selectively adjusted, each of said fixturing members having a generally tubular curl assimilating the curl of a door hinge, an elongated marking guide supported by the lower end portion of said rod in downwardly spaced relation from said lower fixturing member and extending generally perpendicular to said rod, means enabling the vertical spacing between said marking guide and said lower fixturing member to be selectively adjusted, means for supporting said marking guide for up and down pivoting relative to said rod a plane containing said rod, and means for releasably locking said guide in any of several selected pivoted positions in said plane.

7. A marking gage as defined in claim 6 in which said means for releasably locking said guide comprise a strut extending between said rod and said guide, means enabling one end of said strut to be adjusted upwardly and downwardly along said rod, and means enabling the other end of said strut to be adjusted back and forth along said guide.

8. A marking gage for facilitating the cutting of the lower end portion of a door adapted to swing open and closed about an upright axis and on vertically spaced upper and lower hinges, said gage comprising an elongated rod adapted to be located in an upright position, upper and lower fixturing members spaced vertically from one another along said rod, means enabling the vertical spacing between said fixturing members to be selectively adjusted, each of said fixturing members having a generally tubular curl assimilating the curl of a door hinge, an elongated marking guide supported by the lower end portion of said rod in downwardly spaced relation from said lower fixturing member and extending generally perpendicular to said rod, means enabling the vertical spacing between said marking guide and said lower fixturing member to be selectively adjusted, means for supporting said marking guide for up and down pivoting relative to said rod and for releasably locking said guide in a selected pivoted position, said releasably locking means comprising a strut extending between said rod and said guide, means enabling one end of said strut to be adjusted upwardly and downwardly along said rod, and means enabling the other end of said strut to be adjusted back and forth along said guide.

* * * * *